US009528661B2

(12) United States Patent
Ferro

(10) Patent No.: US 9,528,661 B2
(45) Date of Patent: Dec. 27, 2016

(54) LIGHTING MODULE FOR LED-BASED LIGHTING

(71) Applicant: CASTALDI LIGHTING S.P.A., Cassano Magnago (IT)

(72) Inventor: Stefano Ferro, Milan (IT)

(73) Assignee: CASTALDI LIGHTING S.P.A., Cassano Magnago (IT)

( * ) Notice: Subject to any disclaimer, the term of this patent is extended or adjusted under 35 U.S.C. 154(b) by 324 days.

(21) Appl. No.: 14/474,953

(22) Filed: Sep. 2, 2014

(65) Prior Publication Data

US 2015/0062900 A1 Mar. 5, 2015

(30) Foreign Application Priority Data

Sep. 3, 2013 (IT) ..... MI2013A1434

(51) Int. Cl.

| | |
|---|---|
| ***F21K 99/00*** | (2016.01) |
| ***F21V 29/00*** | (2015.01) |
| ***F21S 2/00*** | (2016.01) |
| ***F21V 21/005*** | (2006.01) |
| *F21V 29/80* | (2015.01) |
| *F21Y 101/00* | (2016.01) |

(52) U.S. Cl.

CPC . *F21K 9/30* (2013.01); *F21K 9/20* (2016.08); *F21K 9/90* (2013.01); *F21S 2/005* (2013.01); *F21V 21/005* (2013.01); *F21V 29/004* (2013.01); *F21V 29/80* (2015.01); *F21Y 2101/00* (2013.01); *Y10T 29/49126* (2015.01)

(58) Field of Classification Search

CPC ..... F21K 9/30; F21K 9/90; F21S 2/005; F21V 21/005; F21V 29/004; F21V 29/80; F21Y 2101/02; Y10T 29/49126

USPC ..... 362/249.02, 249.06, 655, 656, 645, 646,362/647

See application file for complete search history.

(56) References Cited

U.S. PATENT DOCUMENTS

| | | | | |
|---|---|---|---|---|
| 7,494,244 | B1 * | 2/2009 | Van Diep | F21S 2/00 362/227 |
| 2006/0152933 | A1 | 7/2006 | Kramer et al. | |
| 2006/0262533 | A1 | 11/2006 | Lin et al. | |
| 2009/0196034 | A1 | 8/2009 | Gherardini et al. | |

OTHER PUBLICATIONS

Italian Search Report dated Feb. 28, 2014 in IT MI20131434 filed Sep. 3, 2013; 2 pages.

* cited by examiner

*Primary Examiner* — Laura Tso
(74) *Attorney, Agent, or Firm* — Brooks Kushman P.C.

(57) ABSTRACT

A lighting module including an electronic board adapted to accommodate a plurality of light emitting diodes (LEDs) is provided. The lighting module includes a metallic base having cavities adapted to receive adapters. The adapters include a connector body provided with: a) means adapted to accommodate electrical contacts for interconnection to the electronic board; b) means adapted to accommodate gaskets for shielding the contacts; and c) means for the mechanical locking of the adapters on the module.

12 Claims, 4 Drawing Sheets

LIGHTING MODULE FOR LED-BASED LIGHTING

CROSS-REFERENCE TO RELATED APPLICATIONS

This application claims priority to Italian Application No. MI2013A001434 filed Sep. 3, 2013, the disclosure of which is incorporated in its entirety by reference herein.

BACKGROUND

In recent years, there has been constant growth in the use of systems based on light emitting diodes, commonly known as LEDs (light emitting diode) which are appreciated increasingly due to their potential to obtain high brightness, to their low price and to their high efficiency and reliability. Such systems are often compact and operate at low voltage, have a high switching rate and their life is typically 1-2 orders of magnitude longer than that of classic light sources.

As a result, LEDs are used increasingly as a replacement of some traditional light sources such as incandescent lamps, halogen lamps or fluorescent lamps.

Typically, LEDs are inserted in electronic boards the dimensions of which are preset during production and can accommodate a variable number thereof. The operator, on the basis of an analysis of the environment to be lit, selects the boards that support an adequate number of LEDs.

In some contexts, however, a plurality of boards are necessary or it may even happen that new LEDs have to be added due to subsequent requirements, such as the need for greater brightness.

Usually, the operator proceeds by installing additional boards, optionally connects them in a makeshift manner or even replaces existing ones with others having suitable dimensions. Obviously, these operations are awkward, since they require the intervention of a person skilled in the art, who must introduce modifications to the existing system, find the new boards that are compatible with the existing ones and connect them for example by using proprietary adapters.

The results often are not satisfactory from a technical, aesthetic and safety standpoint.

SUMMARY

The aim of the present invention is therefore to overcome the limitations of the background art cited above, by proposing therefore a lighting module that allows providing dynamically a lighting system based on the modular connection of a plurality of modules.

Within this aim, an object of the present invention is to propose a module that allows creating interconnections with other equivalent or compatible modules.

This aim and these and other objects that will become better apparent hereinafter are achieved by a module according to appended claim 1.

This aim and these and other objects that will become better apparent hereinafter are also achieved by a method according to appended claim 9.

Advantageously, the module allows creating interconnections easily and effectively.

Conveniently, the module allows flexibility and ease of maintenance.

Preferably, the module allows providing interconnections of modules that are mechanically and electrically safe.

BRIEF DESCRIPTION OF THE DRAWINGS

Further characteristics and advantages of the invention will become better apparent from the following detailed description, given by way of non-limiting example, accompanied by the corresponding figures, wherein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1A:
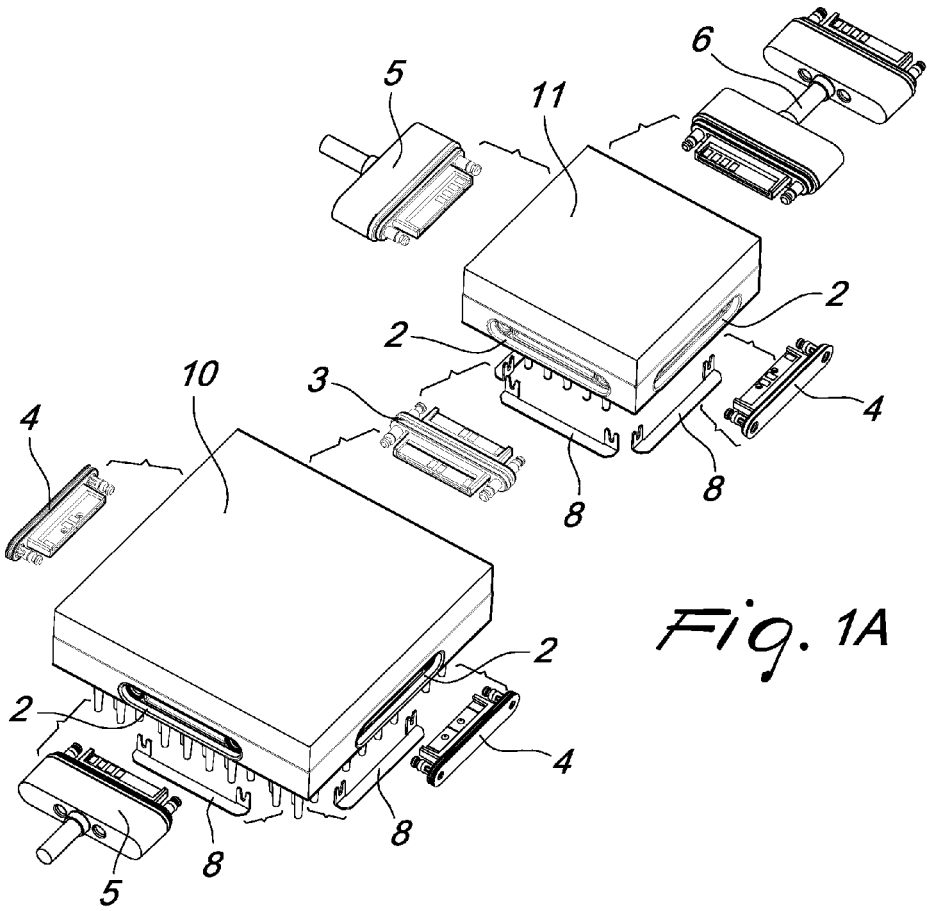
FIG. 1A is a perspective exploded view of an interconnection of two lighting modules according to the present invention.

An exemplifying architecture of the interconnection of modules according to the present invention is summarized in the block diagram of FIG. 1A.

FIG. 1A shows modules 10 and 11 and a plurality of adapters 3, 4, 5 and 6. Although reference shall be made hereinafter only to two modules, the person skilled in the art understands that their number can vary and depend only on the dimensions of the system to be provided or on the choices of the operator.

The modules 10 and 11 are devices capable of providing lighting based on LEDs. The modules 10 and 11 each comprise at least one electronic board, not shown in the figure, and a metallic base.

The electronic board is a device that is configured to accommodate a variable plurality of diodes of the LED type, for example nine for the module 10 and four for the module 11, preferably arranged uniformly on its surface. The electronic board is arranged within the metallic base.

The metallic base preferably is shaped like a parallelepiped. Preferably, the upper wall of the metallic base comprises a frame that offers IK protection, while the lower surface of the base is adapted to accommodate a heat sink connected by means of a thermal interface. The metallic base has on the side walls cavities 2 adapted to accommodate the adapters 3, 4, 5 and 6.

Each one of the adapters 3, 4, 5 and 6 is provided in order to perform a particular task, but all of them comprise at least one connector body capable of accommodating electrical contacts and means for mechanical locking on the modules 10 and 11.

Typically, locking is provided by way of mechanical pins connected to brackets 8 fixed to the base of the modules.

Preferably, the connector has receptacles that allow the insertion of IP67 hermetic gaskets to protect the contacts. The gaskets can be integrated on the connector or inserted by the operator.

The adapter 3 has the purpose of interconnecting electrically and mechanically the modules 10 and 11 by insertion between two respective cavities 2. In the preferred embodiment, the adapter 3 has a connector body that accommodates an electronic board provided with gold-coated pads, the insertion of which places in contact electrically the electronic boards of the modules 10 and 11, allowing electrical connection.

In this manner, the two modules 10 and 11, once interconnected, can be seen as a single light source provided with thirteen LEDs.

The connector body of the adapter 3 is provided furthermore with two pairs of non-reversible metallic pins, each of which is fixed on the respective brackets 8 of the modules 10 and 11, so as to render the interconnection stable from the mechanical point of view.

A variation of the adapter 3 is constituted by the adapter 6, which has two contact boards and a connector body that comprises a cable.

The adapter 6 allows connecting two modules that are distant or in any case not directly adjacent. The interconnections of modules provided by means of the adapters 3 are therefore more compact than those provided by means of the adapters 6.

The adapter 4 has the task of sealing the cavities 2 of the modules 10 and 11 that are free, i.e., that are not used for modular interconnection. The adapter 4 has a connector body, which has two sections, the first one adapted to be inserted in the cavity 2 and fixed for example with the aid of mechanical pins to the brackets 8 and the second one provided with a sealing gasket with IP67 seal.

Once inserted, the adapter 4 allows to protect the electronic board of the modules 10 and 11 from dust and liquids and to preserve it against damage due to accidental contacts caused by the insertion of foreign objects.

The adapter 4 can be provided also with an electronic board to close the circuit produced by the interconnection of a plurality of modules.

The adapter 5 has a purpose of supplying power to the modules 10 and 11 and comprises, on the side of the connector body that interfaces with the cavities 2, an electronic board and, on the opposite side, an enclosure that contains circuitry, not shown in the figure, which allows supplying power to the modules 10 and 11. The adapter 5 is shown in greater detail in FIG. 1B.

Figure 1B:
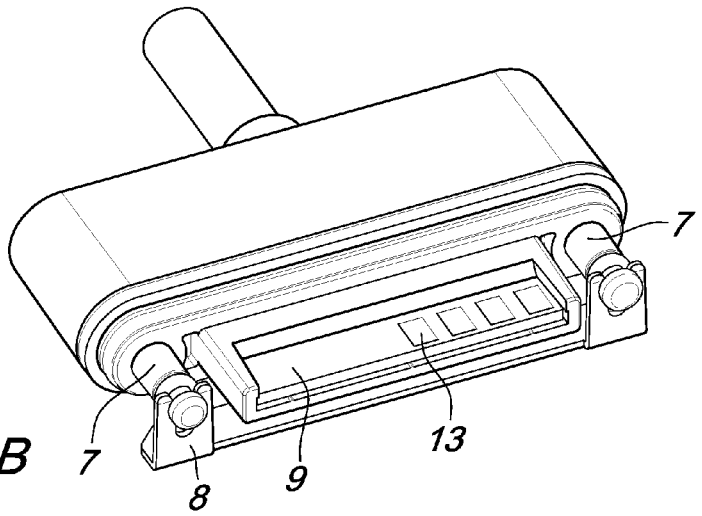
FIG. 1B is a perspective view of an adapter used in the system of FIG. 1A.

FIG. 1B shows in greater detail the power supply adapter 5. In particular, the adapter 5 is provided with metallic pins 7 adapted to be fixed mechanically to a bracket 8 arranged on the module 10, 11. The connector body of the adapter 5 contains an electrical contact board 9 provided with gold-coated pads 13. The gold-coated pads 13 are adapted to be connected to contact springs that are arranged on the electronic boards of the modules 10 and 11. In this manner, the power supplied by the cable on the contact board 9 flows by means of the pads 13 and the contact springs to the modules 10 and 11.

Figure 2A:
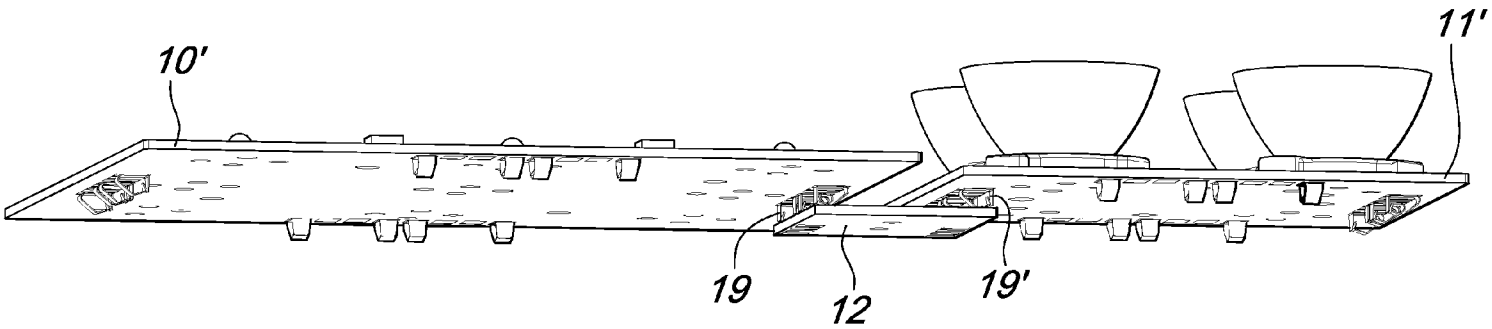
FIGS. 2A and 2B are perspective views illustrating in greater detail an aspect of the interconnection of FIG. 1A.
Figure 2B:
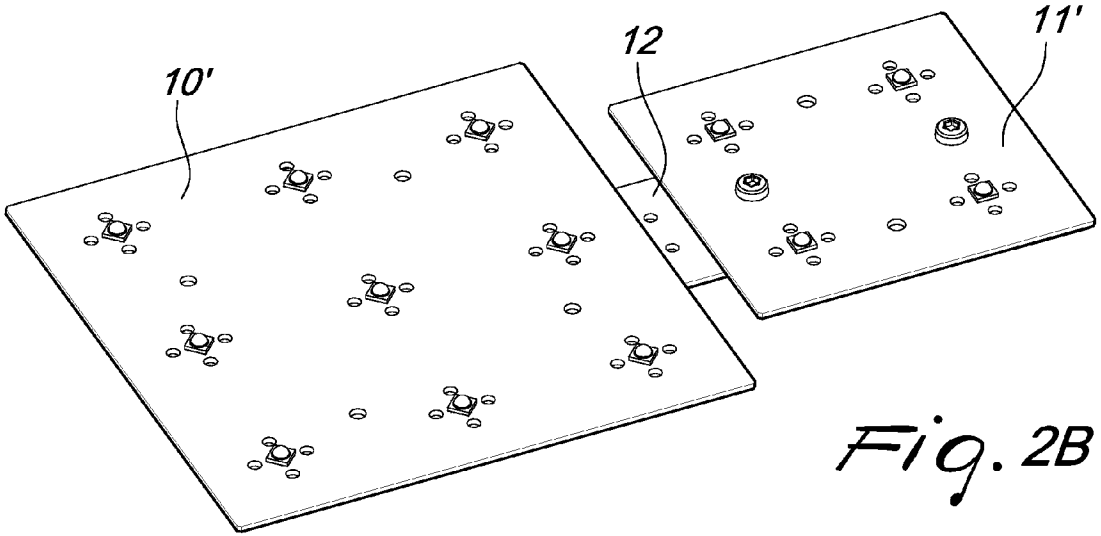

FIGS. 2A and 2B show schematically the interconnection of the modules 10 and 11 provided by means of the adapter 3. Merely for the sake of clarity in description, these Figures show only some of the electrical components of the system of FIG. 1A.

In particular, the respective electronic boards 10' and 11' of the modules 10 and 11 connected by means of the spring-loaded contacts 19, 19' to the board provided with electrical contacts 12 of the adapter 3 are shown. In this embodiment, the module 11 is provided furthermore with lenses arranged on the LEDs.

Figure 3B:
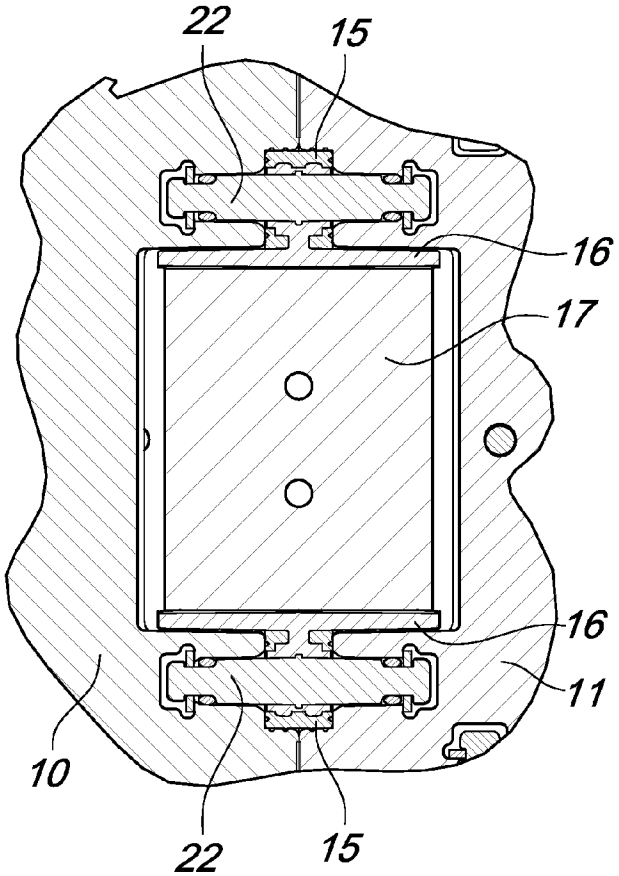
FIGS. 3A and 3B are sectional views illustrating in greater detail a second aspect of the interconnection of FIG. 1A.
Figure 3A:
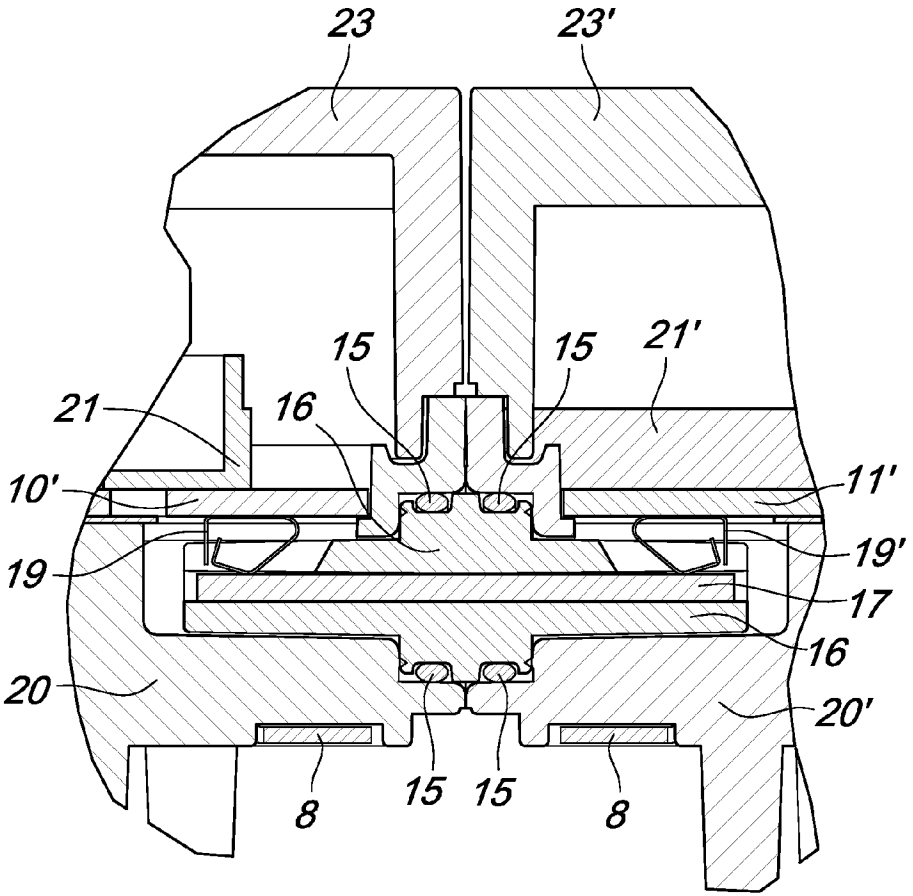

FIGS. 3A and 3B show respectively a front view and top view of the interconnection between the two modules 10 and 11, which is provided by means of the adapter 3.

The adapter 3 comprises elements 16, 17 and 22. The left portion of FIG. 3A, i.e., the one that contains the electronic board 10', shows the interconnection cross-section of the module 10. The right portion instead refers to the module 11.

In particular, FIGS. 3A and 3B show a connector body 16 on which a board with the contacts 17 is arranged and protected by means of gaskets 15 of the O-ring type.

The board provided with contacts 17 is connected electrically to the electronic board 10', 11' of the modules 10 and 11 by means of the contact springs 19, 19'.

Preferably, the boards 10', 11' are arranged respectively below a layer of resin, preferably two-part epoxy or polyurethane resin 21, 21' with an IP67 protection and aesthetic function.

Preferably, the modules 10 and 11 comprise a transparent protective covering 23, 23' that allows the light to filter. The pins 22 allow the mechanical seal of the adapter on the brackets 8 of the modules 10 and 11.

The interconnection of the two modules 10, 11 by insertion in the cavity 2 of the adapter 3 has the result of creating a new light source composed of thirteen LEDs inserted in a firmly connected structure.

In practice it has been found that the module and the method described achieve the intended aim and objects. In particular, it has been shown that the system thus conceived overcomes the quality limitations of the background art, allowing creating a lighting system that is easily expandable by using modular components.

If a module is defective, it is sufficient to disconnect it by sliding off the metallic pins, and replacing it with an equivalent one.

Once interconnection has been provided, it can be expanded by connecting a new module at any time by using one of the free cavities 2 of the modules. The electrical and signal connection (comprising preferably up to eight tracks), as well as the mechanical one, is, thanks to the particular structure of the connectors, completely concealed from sight. In this manner, the interconnection on the one hand appears as a bright aggregation without any discontinuity and on the other hand ensures adequate structural rigidity. Obviously, the person skilled in the art understands without inventive effort that it is possible also to provide connectors that are visible, when used to interconnect the modules, to an external observer.

Furthermore, thanks to the IP67 degree of protection, the interconnection between the module and the connector can be considered hermetic. Other characteristics, for example the use of resins to aggregate its various components, ensure the same level of protection to the other parts of the module.

Although in the present description reference has been made to the two modules 10 and 11, the person skilled in the art understands that the present invention allows interconnecting a disparate number of modules, even of different sizes, by using the cavities 2 that are present on the metallic base.

Furthermore, it is possible to connect to the modular interconnection also other devices that are provided, however, with adequate structural characteristics (such as the use of particular materials and finishings). These devices might comprise power supplies, electronic drivers based on various protocols such as DALI (Digital Addressable Lighting Interface), photocells, video cameras, emergency power supplies, receivers, transmitters, sensors, which can be used moreover also as simple spacers.

Clearly, numerous modifications are evident and can be performed promptly by the person skilled in the art without abandoning the protective scope of the present invention.

Figure 1C:
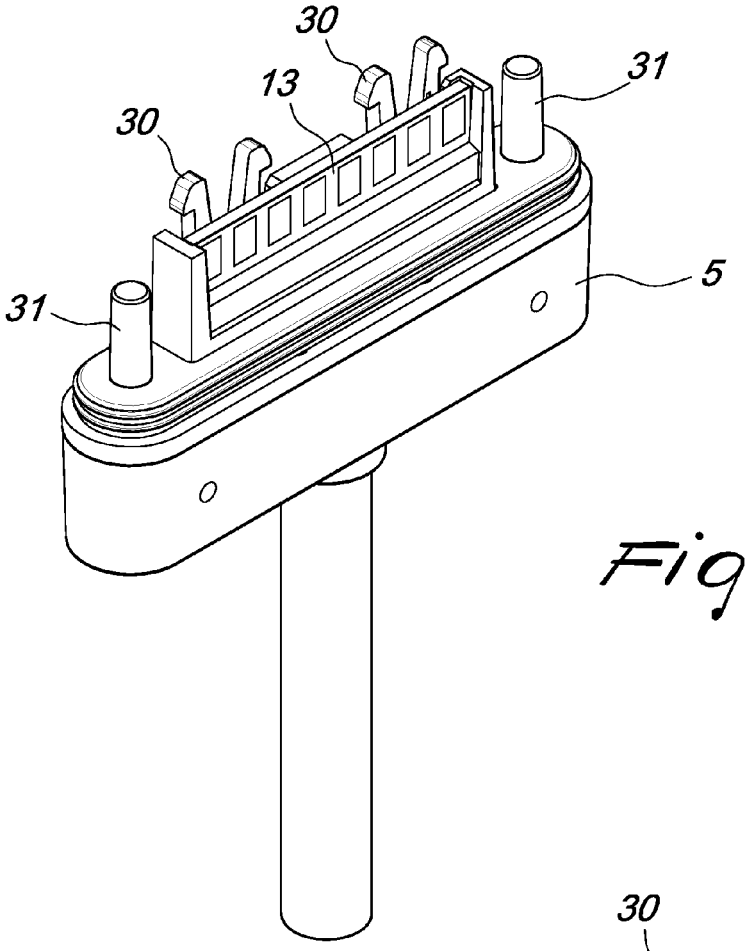
FIG. 1C is a perspective view of a different embodiment of the adapter of FIG. 1B.
Figure 1D:
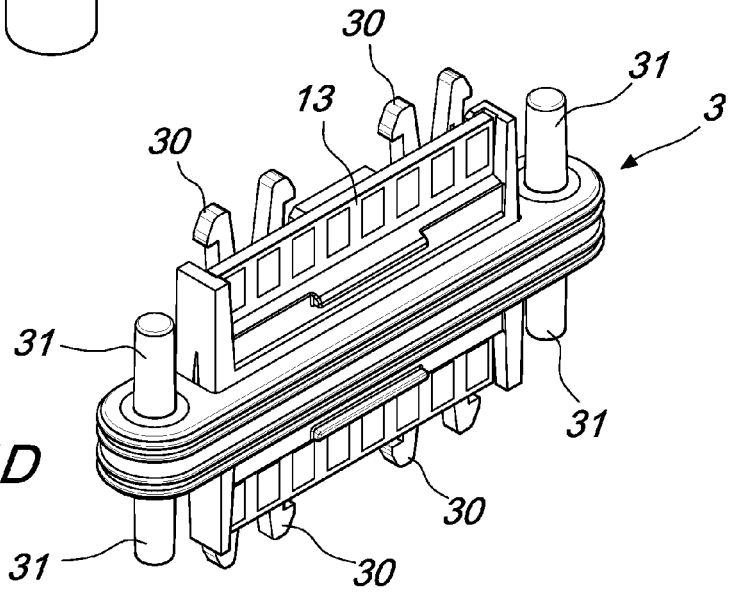
FIG. 1D is a perspective view of a further embodiment of the adapter of FIG. 1A.

Thus, for example, FIGS. 1C and 1D show different embodiments of the adapter illustrated in FIGS. 1A and 1B.

In such embodiments the adapter 3, 4, 5 and 6 is provided with at least one pair of clips 30. The adapter 3 is provided with two opposite pairs of clips 30, while the adapter 4, 5 and 6 (only adapter 5 is illustrated for simplicity) is provided with one pair of clips 30. The clips 30 have the purpose of mechanically locking the adapter into the modules 10 and 11.

In those embodiments the metallic pins 7 are replaced by metallic pins 31 that have the purpose of guiding the adapter.

For example, although reference has been made to the metallic base as having the shape of a parallelepiped, it can also assume other polyhedral shapes.

Moreover, the module might have lenses integrated in the system, or in the frame for IK protection, and fixed to the electronic board by means of epoxy or polyurethane resin. For example, the module might be provided with a primary lens such as a plastic spider or an IK plastic protection. Both types of lenses can be used preferably with metallic bases that have at least five faces. The structured frame can be transparent or treated on its surface for programmed light diffusion.

It is furthermore possible to also provide secondary lenses adapted to orient the light emitted by the LEDs so as to form a precise photometric solid. Such lenses can be fixed to the electronic board by means of adhesive or resins or inserted in cavities obtained during the step of molding the IK protection.

Preferably, the LEDs are monochrome, RGB, RGB white, or comprise OLED boards.

The module might also have no lenses but might comprise an additional protective frame integrated in the frame for IK protection. Moreover, the module might not have IK protection if it is not necessary.

Furthermore, the modules might be provided with additional circuitry adapted to drive a plurality of modules connected thereto.

The module provided with such circuitry might have various functionalities, such as the management of the colors of the LEDs, act as a power supply or as an emergency battery or as a DALI module, integrate a presence detector and a radio control receiver and be adapted to transmit data by means of a BUS module.

Furthermore, the module proper can be a luminaire.

Therefore, the scope of protection of the claims must not be limited by the illustrations or preferred embodiments shown in the description by way of examples, but rather the claims must comprise all the characteristics of patentable novelty that reside in the present invention, including all the characteristics that would be treated as equivalents by the person skilled in the art.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A lighting module comprising an electronic board adapted to accommodate a plurality of light emitting diodes (LEDs), and a metallic base comprising cavities adapted to receive adapters, the adapters comprising a connector body provided with: a) means adapted to accommodate electrical contacts for interconnection to the electronic board; b) means adapted to accommodate gaskets for shielding the contacts; and c) means for the mechanical locking of the adapters on the module.

2. The module according to claim 1, wherein the metallic base is shaped substantially like a parallelepiped in which the side walls are each adapted to accommodate one of the cavities; the metallic base further having the lower wall additionally adapted to accommodate a thermal interface that is connected to a heat sink; the metallic base further having the upper wall adapted to accommodate a transparent protective frame.

3. The module according to claim 1, wherein the locking means comprise metallic pins and the metallic base comprises brackets for interconnection with the pins.

4. The module according to claim 1, wherein the electronic board is connected to the electrical contacts by means of spring-loaded contacts, the electronic board being further adapted to receive a plurality of lenses connected by means of a layer of resin or adhesive material.

5. The module according to claim 1, wherein the adapter comprises a connector body that contains a board provided with electrical contacts, the connector body comprising two identical and symmetrical sections, each provided with a pair of metallic pins.

6. The module according to claim 5, wherein the sections of the adapter are connected by means of a cable.

7. The module according to claim 1, wherein the adapter comprises a connector body that has an electric contact board and an extensible cable that is connected to the electric power supply.

8. The module according to claim 1, wherein the adapter is further adapted to seal the cavity by means of a gasket adapted to ensure the electrical insulation of the electronic board.

9. The module according to claim 1, wherein the means for the mechanical locking of the adapter on the modules comprise at least one pair of clips and metallic pins.

10. A method for interconnecting lighting modules, comprising the steps of:

providing at least two modules comprising an electronic board adapted to accommodate a plurality of light emitting diodes (LEDs), and a metallic base that comprises cavities adapted to receive adapters, the adapters comprising a connector body provided with: a) means adapted to accommodate electrical contacts for interconnection with the electronic board; b) means adapted to accommodate gaskets for shielding the contacts; and c) means for the mechanical locking of the adapters on the modules;

interconnecting the electronic boards of the modules by means of the insertion in the cavities of an adapter that contains a board provided with electrical contacts.

11. The method according to claim 10, further comprising the steps of:

supplying the modules by means of an adapter that is connected by means of an electrical cable to a power source;

sealing the cavities by means of adapters that have a gasket adapted to ensure electrical insulation;

fixing the adapters by means of metallic pins connected to brackets arranged on the modules.

12. A luminaire, constituted by at least one module according to claim 1.

* * * * *